US010192412B2

(12) United States Patent
Lin et al.

(10) Patent No.: US 10,192,412 B2
(45) Date of Patent: Jan. 29, 2019

(54) INTERCOM SYSTEM FOR EMERGENCY RESCUE

(71) Applicant: INWELLCOM TECHNOLOGY CO., LTD., Taipei (TW)

(72) Inventors: Jian-Jr Lin, Taipei (TW); Ke-Sen Huang, Taipei (TW)

(73) Assignee: Inwellcom Technology Co., Ltd., Taipei (TW)

( * ) Notice: Subject to any disclaimer, the term of this patent is extended or adjusted under 35 U.S.C. 154(b) by 0 days.

(21) Appl. No.: 15/804,169

(22) Filed: Nov. 6, 2017

(65) Prior Publication Data

US 2018/0137723 A1 May 17, 2018

(30) Foreign Application Priority Data

Nov. 15, 2016 (TW) ..... 105137241 A

(51) Int. Cl.

| | |
|---|---|
| ***G08B 7/06*** | (2006.01) |
| ***G08B 17/06*** | (2006.01) |
| ***G08B 25/00*** | (2006.01) |
| ***G08B 25/08*** | (2006.01) |
| ***G08B 25/12*** | (2006.01) |
| ***G08B 25/14*** | (2006.01) |
| ***G08B 27/00*** | (2006.01) |

(52) U.S. Cl.

CPC ..... *G08B 7/066* (2013.01); *G08B 25/009* (2013.01); *G08B 25/085* (2013.01); *G08B 25/14* (2013.01); *G08B 27/003* (2013.01); *G08B 27/005* (2013.01); *G08B 17/06* (2013.01); *G08B 25/12* (2013.01)

(58) Field of Classification Search

None

See application file for complete search history.

(56) References Cited

U.S. PATENT DOCUMENTS

| | | | | |
|---|---|---|---|---|
| 2009/0273463 | A1* | 11/2009 | Morwood | G08B 25/007 340/514 |
| 2014/0025263 | A1* | 1/2014 | Geyer | B60K 35/00 701/49 |
| 2014/0132393 | A1* | 5/2014 | Evans | G08B 21/02 340/6.11 |
| 2015/0170503 | A1* | 6/2015 | Wedig | G08B 7/066 340/691.5 |

* cited by examiner

*Primary Examiner* — Thomas S McCormack

(74) *Attorney, Agent, or Firm* — Rosenberg, Klein & Lee

(57) ABSTRACT

An intercom system for emergency rescue has a user extension, an administration server and a management device. The user extension has a serial number and is capable of generating an alarm signal by operation. The administration server connects to the user extension and the management device to receive the alarm signal. A plot plan recording a location of the user extension is stored in the administration server. The administration server transmits the plot plan with the location of the user extension that outputs the alarm signal to the management device to display. Therefore, an administrator equipped with the management device communicates with the user extension via a video connection established by the administration server. With the help of the plot plan and the video connection, the administrator provides timely assistance to reduce casualties.

17 Claims, 10 Drawing Sheets

INTERCOM SYSTEM FOR EMERGENCY RESCUE

BACKGROUND OF THE INVENTION

1. Field of the Invention

The present invention relates to a rescue system, especially an intercom system for emergency rescue.

2. Description of the Prior Arts

When emergency occurs, such as a fire accident, seeking rescue via a phone call or ringing a bell in the public place during the golden hours may reduce causalities. In case of a community emergency, seeking rescue by a communication system from a community administrator may be another way besides calling.

As an example shown in FIG. 7, community residents may activate a fire alarm and call for help with the communication system from a community administrator when a fire breaks out. If the community administrator is in the management office, he can offer help immediately. Otherwise, if the community administrator is out on duty, he cannot offer help until coming back to the office in response to the calling of the fire alarm.

As shown in FIG. 8, after receiving the rescue call, the community administrator will ask firefighters and ambulance for rescue and/or coordinate other community administrators to assist based on his experience. The administrator will guide the residents to evacuate by broadcasting, if evacuation is needed. At last, the community administrator will communicate with the residents who report the fire to inquire about the situation of the fire and the residents located there.

As shown in FIG. 9, when firemen and ambulance personnel arrive at the community, they need to know the location and situation of the fire for setting up rescue strategy or fire rescue equipment. Generally, the firemen may either know the location of the fire by the ringing of the fire alarm or know the location and situation by asking survivors escaping from the fire.

However, the survivors may be terrified by the fire and cannot accurately describe the situation of the fire. This may adversely affect setting up of rescue strategy or the fire rescue equipment. The rescue time may be delayed, since determining the location of the fire according to the fire alarm will take a lot of time.

As shown in FIG. 10, after the emergency, the community administrator needs to record the whole accident and the handling process as a reference for the emergency management in the future. But the community administrator has received a vast amount of information within a very short time during the emergency, such that the administrator can hardly remember the details and may acquire little useful experience. Thus, the record is barely helpful for emergency procedure in the future.

To sum up, the existing emergency response may neither get in touch with the community administrator immediately nor provide sufficient information for the rescuers. Moreover, the administrator may not provide the detailed emergency handling record after the emergency. These make it difficult to get fast rescue in the shortest time, thus the existing emergency rescue responses need improvement.

SUMMARY OF THE INVENTION

The present invention provides an intercom system for emergency rescue for the rescuer to promote the efficiency of rescue. The intercom system for emergency rescue comprises:

- at least one user extension each having a serial number and capable of generating an alarm signal according to an operation;
- an administration server connected to the at least one user extension either via a wired connection or a wireless connection in order to receive the alarm signal, wherein a plot plan is stored in the administration server and has a figure number corresponding to the serial number of the at least one user extension, a location of the at least one user extension is shown on the plot plan, wherein when the administration server receives the alarm signal outputted from the at least one user extension, the administration server affirms the serial number of the at least one user extension and recognizes the plot plan having the figure number corresponding to the serial number of the at least one user extension that outputs the alarm signal;
- at least one management device connected to the administration server either via a wired connection or a wireless connection, when the administration server receives the alarm signal, the administration server establishes a video connection between the at least one management device and the at least one user extension and transmits the plot plan that has the figure number corresponding to the at least one user extension to the at least one management device.

In case of emergency, a resident will operate the user extension to generate an alarm signal and send the alarm signal to the administration server. Then the administration server will establish a video connection between the user extension and the management device such that the resident may ask for assistance. Moreover, the administration server may recognize the plot plan having the figure number corresponding to the serial number of the user extension that outputs the alarm signal and transmit the plot plan to the management device. The administrator equipped with the management device may rapidly find out the location of the user extension for rescue. Thus, the resident may rapidly get in touch with the administrator and ask for rescue by the user extension, while the administrator may timely reach the location of the emergency to provide assistance in order to reduce casualties.

DETAILED DESCRIPTION OF THE INVENTION

Figure 1:
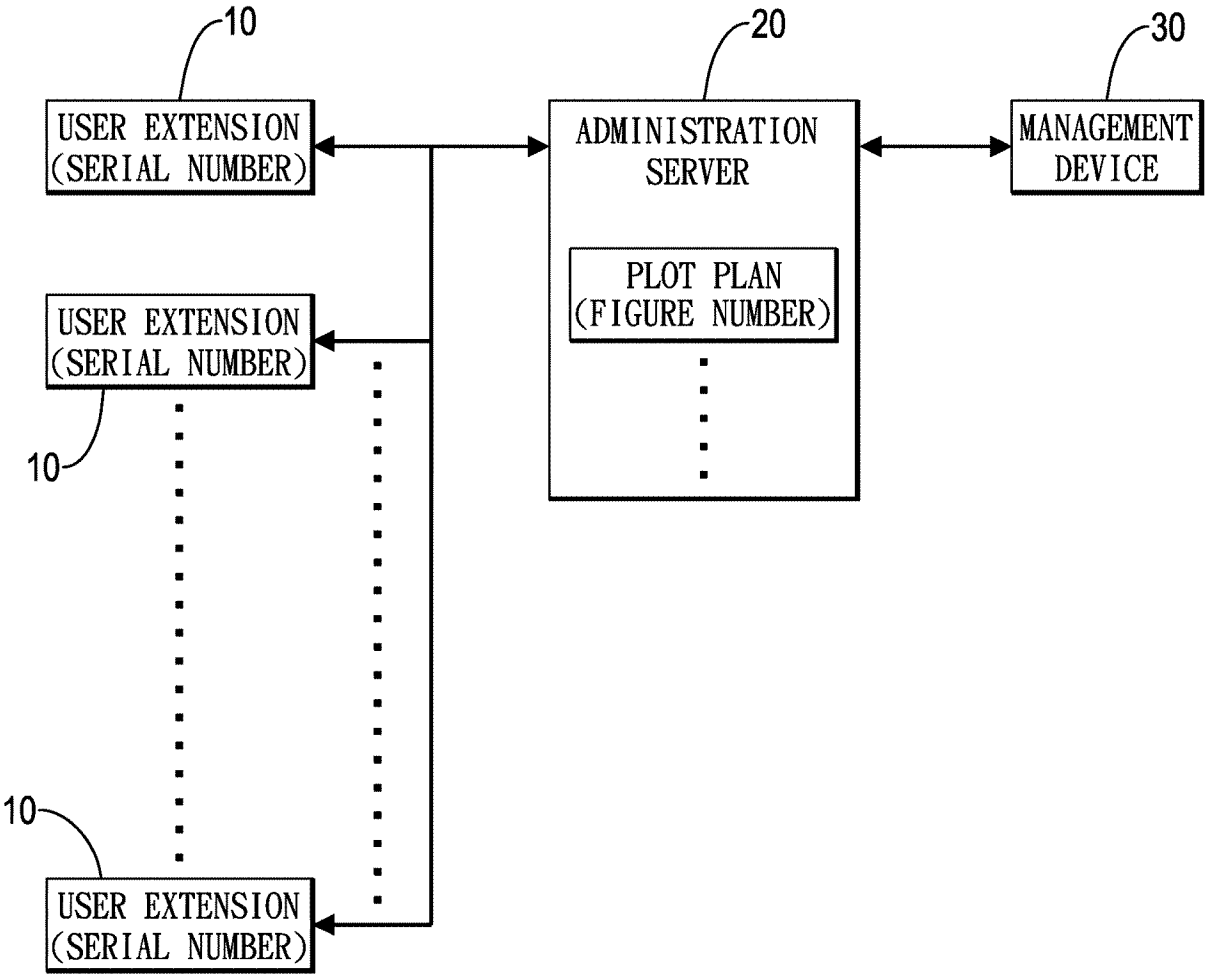
FIG. 1 is a block diagram of a preferred embodiment of the intercom system for emergency rescue of the present invention.

As shown in FIG. 1, the present invention provides an intercom system for emergency rescue, which comprises at least one user extension 10, an administration server 20 and at least one management device 30.

Each of the at least one user extension 10 has a serial number and is capable of generating an alarm signal according to an operation.

The administration server 20 is connected to each of the at least one user extension 10 either via a wired connection or a wireless connection in order to receive the alarm signals. There is at least one plot plan stored in the administration server 20. Each of the at least one plot plan has a figure number. The location of the at least one user extension 10 is shown on the plot plan. When the administration server 20 receives the alarm signal outputted from any one of the at least one user extension 10, the administration server 20 may affirm the serial number of the user extension 10 that outputs the alarm signal and recognize the plot plan having the figure number corresponding to the serial number of the user extension 10 that outputs the alarm signal.

Each of the at least one management device 30 is connected to the administration server 20 either via a wired connection or a wireless connection. When the administration server 20 receives an alarm signal outputted from one of the at least one user extension 10, the administration server 20 may establish a video connection between any one of the at least one management device 30 and the user extension 10 that outputs the alarm signal. Meanwhile, the administration server 20 may transmit the plot plan with the figure number corresponding to the user extension 10 that outputs the alarm signal to the management device 30. An administrator may confirm the location of the emergency via the management device 30. In this preferred embodiment, each of the at least one management device 30 can be a management platform, a personal computer, a mobile device or a wearable device.

In the embodiment described hereinafter, the intercom system for emergency rescue comprises multiple user extensions 10 and multiple management devices 30.

When the administration server 20 receives an alarm signal outputted from one of the user extensions 10, the administration server 20 may create a video or an audio connection between one of the management devices 30 with the user extension 10 that outputs the alarm signal. In another embodiment, when the administration server 20 receives an alarm signal outputted from one of the user extensions 10, the administration server 20 may also create video or audio connections among the multiple management devices 30 with the user extension 10 that outputs the alarm signal. Furthermore, in another embodiment, when the administration server 20 receives alarm signals outputted from the user extensions 10, the administration server 20 may create video or audio connections among the multiple management devices 30 with the multiple user extensions 10.

In addition, the administration server 20 can perform a broadcasting function. The broadcasting function may establish a communication between one of the management devices 30 and one of the user extensions 10, communications among one of the management devices 30 with multiple user extensions 10, communications among multiple management devices 30 with one of the user extensions 10, communications among multiple management devices 30 with multiple user extensions 10 or a communication between at least two different user extensions 10. Each of those communications can be a video connection or an audio connection.

In case of emergency, an operator may use one of the user extensions 10 to output the alarm signal to the administration server 20. The video connection will be established by the administration server 20 between the user extension 10 and any one of the management devices 30 when the administration server 20 receives the alarm signal. The operator may timely seek rescue via the user extension 10 by the video connection. Meanwhile, the administration server 20 may affirm the serial number of the user extension 10 that outputs the alarm signal, recognize the plot plan having the figure number corresponding to the serial number of the user extension 10, and transmit the plot plan corresponding to the user extension 10 to the management device 30. The location of the user extension 10 is shown on the plot plan so that the administrator will obtain the location of the user extension 10 that outputs the alarm signal in order to offer help to the operator. Thus, when the emergency occurs, not only will the operator get in touch with the administrator in time via the user extension 10, but also will the administrator rapidly arrive at the emergency location, in this way, it will make the operator get the timely rescue and minimize losses and causalities.

For instance, each household of a community building is installed with one user extension 10. An administration server 20 is synergistically installed in the management office of the community building. The administrator of the community building is equipped with one management device 30.

Figure 2:
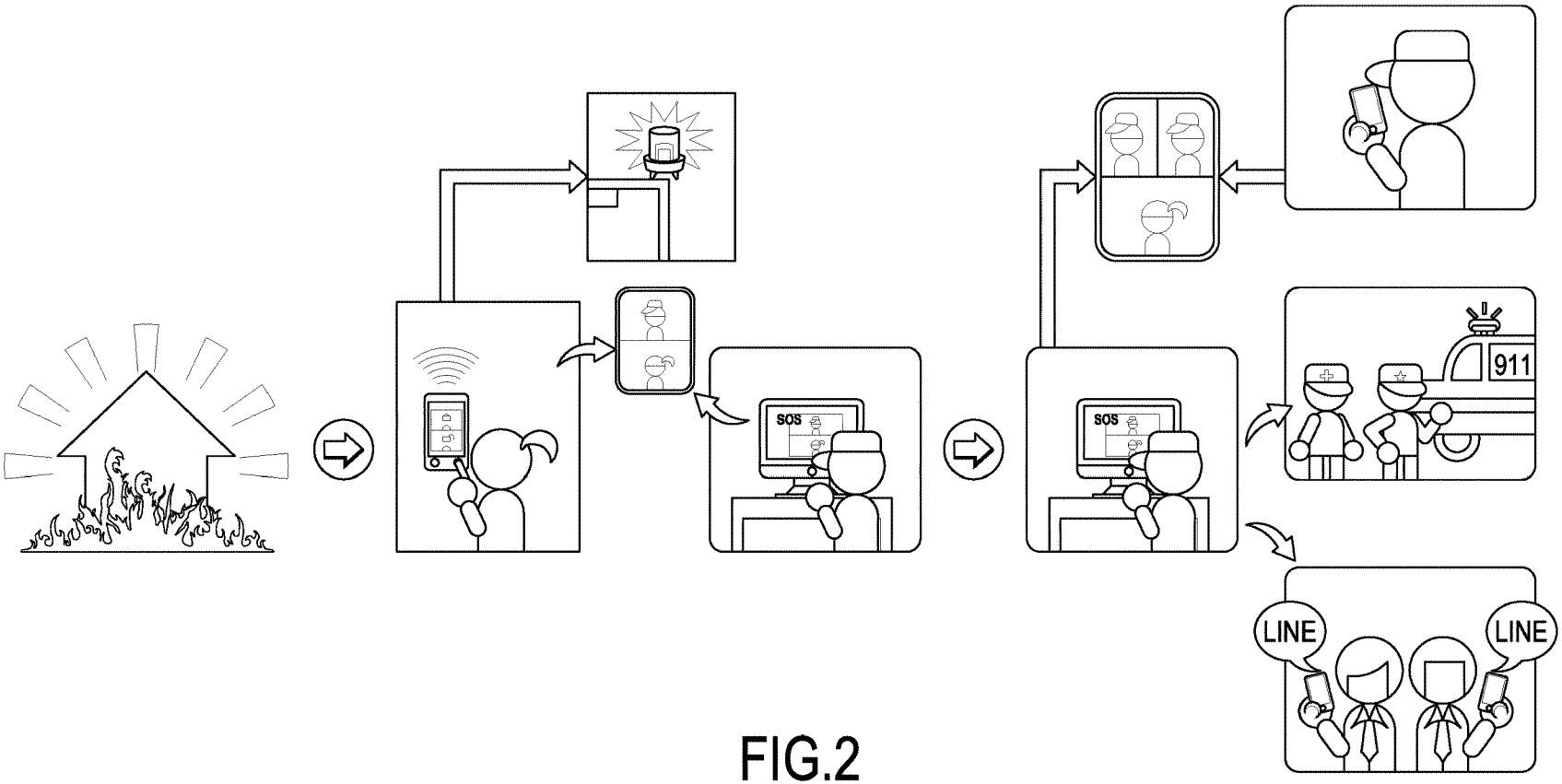
FIG. 2 to FIG. 5 show schematic views of operating a preferred embodiment of the intercom system for emergency rescue in accordance with the present invention.

As shown in FIG. 2, when a resident of the community building sees a fire, the resident operates the user extension 10 in the resident's household to generate an alarm signal. After the user extension 10 sends the alarm signal to the administration server 20, the administration server 20 establishes a video connection between the user extension 10 and the management device 30, so that the resident may get in touch with the administrator via the video connection, in order to ask for assistance.

After that, the administrator may ask firefighters and ambulance for rescue, in the meantime, the administrator may also alert other residents of the community building via the video connections with other user extensions 10 to evacuate the residents to reduce casualties. In this preferred embodiment, the administration server 20 may further store reporting information of each one of the user extensions 10. When the administration server 20 receives the alarm signal generated by the user extension 10, the administration server 20 may transmit the respective reporting information of the user extension 10, according to the serial number of the user extension 10 that outputs the alarm signal, to the management device 30. The reporting information may comprise identity information. When the administration server 20 receives the alarm signal, the administration server 20 will further send an emergency alert according to the identity information to a receiving device.

For example, when the administration server 20 receives an alarm signal from one of the user extensions 10, the reporting information, including the owner information of the user extension 10, the identity information, the nature and the usage of the location, etc., corresponding to the user extensions 10 will be transmitted to the administrator to provide further rescue information. Meanwhile, the administration server 20 may also send an emergency alert to a receiving device such as a mobile phone or a computer, etc., according to the identity information through network by E-mail or some other instant messaging. Thus, the operator of the receiving device will be aware of the situation of the community building.

Figure 3:
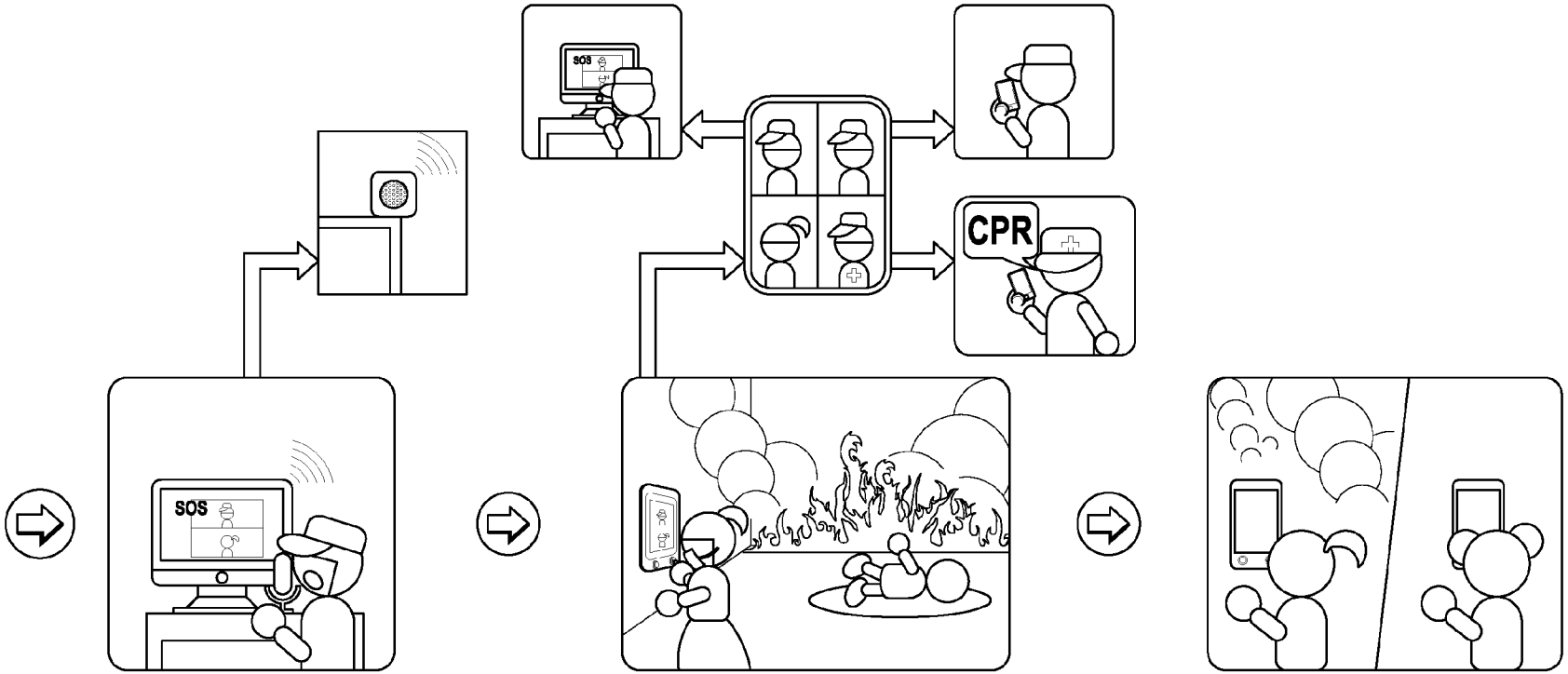

As shown in FIG. 3, broadcasting signals may be transmitted to the administration server 20 from the management device 30 by the administrator. Then the administration server 20 will broadcast to the user extensions 10 to guide the residents to evacuate. Moreover, the administrator may transfer the management device 30 to the firefighters and ambulance personnel in order to provide professional assistance and first aid guidance to the residents via the video connection to increase the chance of rescue.

In this example, the administration server 20 establishes the video connections among the user extension 10 that outputs the alarm signal with other user extensions 10. Thus, the residents in the community building may get in touch with each other to report their situations during the emergency.

Figure 4:
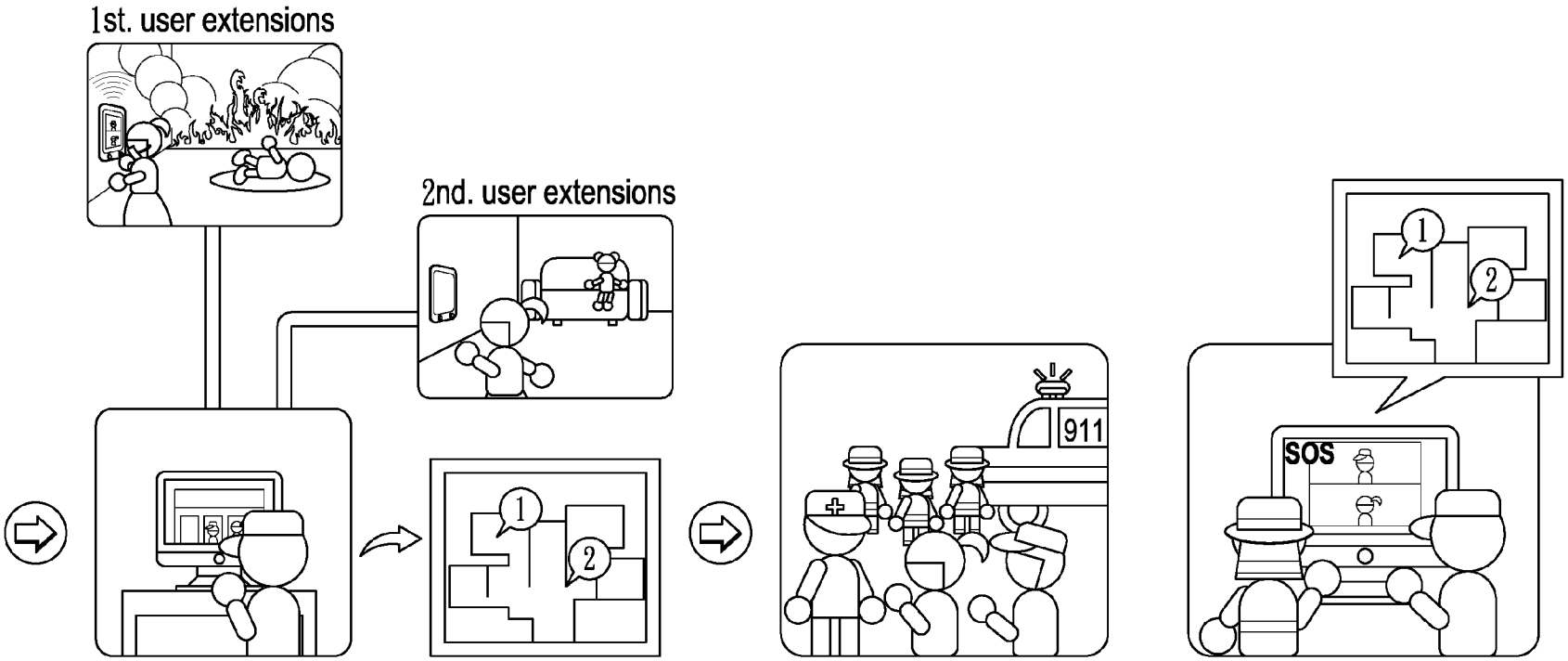

As shown in FIG. 4, the plot plan is stored in the administration server 20. The plot plan has the figure number corresponding to the serial numbers of the user extensions 10. The locations of the user extensions 10 are shown on the plot plan. When the administration server 20 receives the alarm signal, the administration server 20 may affirm the serial number of the user extension 10 that outputs the alarm signal and recognize the plot plan corresponding to the user extension according to relationship between the figure number and the serial numbers. By means of checking the plot plan to obtain the location of the user extension 10 that outputs the alarm signal, the administrator may rapidly find out the location of the emergency for rescue. Moreover, when the firefighters and ambulance personnel arrive, the administrator may inform the firefighters and ambulance personnel via the management device 30 with the plot plan to provide the layout of the community building and the location of the emergency as accurate guidance for rescue.

Figure 5:
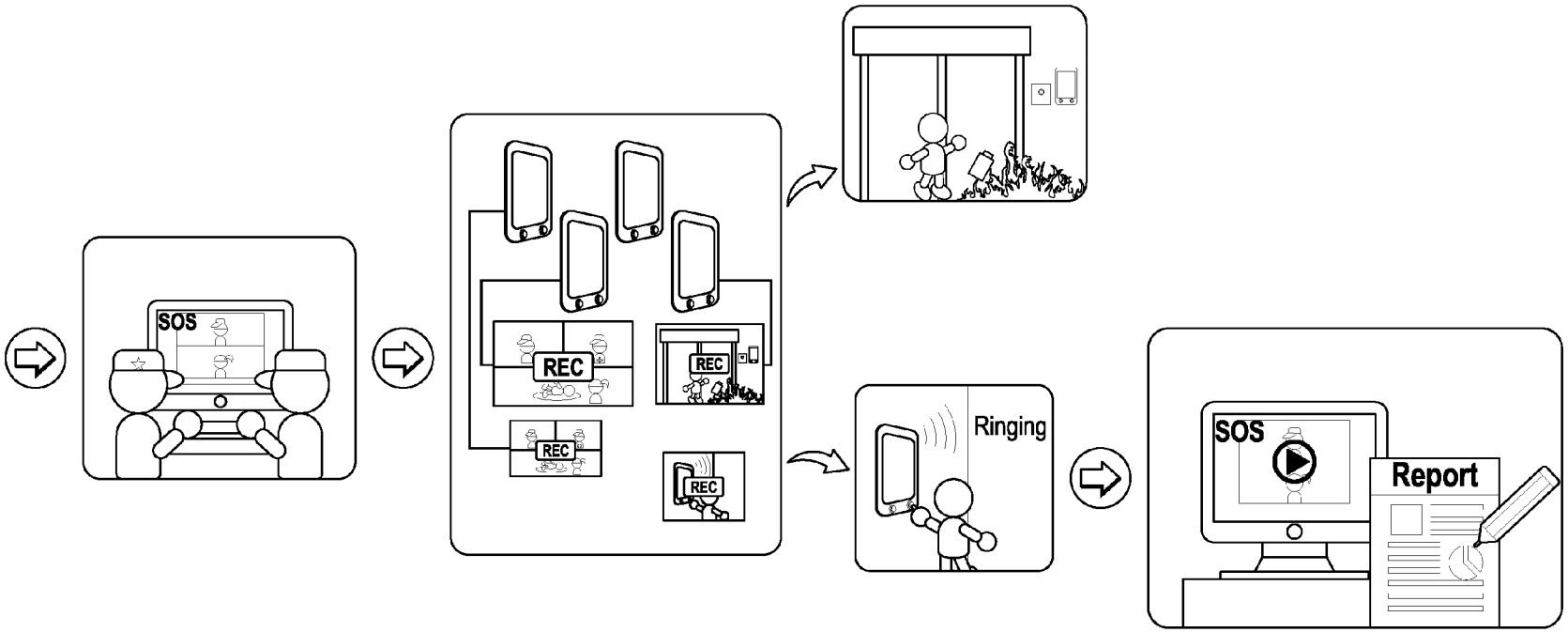

After the emergency, as shown in FIG. 5, as the video connection among the user extension 10 with the management device 30 is established by the administration server 20, video data of the video connection is stored in the administration server 20. In details, when the administration server 20 receives the alarm signal, the administration server 20 may record the time that the alarm signal is received as a receiving time. The administration server 20 will store the video data in a particular time period before the receiving time and the video data of the video connection between the user extension 10 and the management device 30 after the receiving time.

For instance, the user extensions 10 may always record the video data in 24 hours. If the administration server 20 receives the alarm signal at 11:10 AM, then 11:10 AM will be recorded as the receiving time, the administration server 20 will store the video data generated in a particular time period, for example, 5 minutes, before the receiving time 11:10 AM, and the video data of the communication of between the user extensions 10 and the management devices 30 is generated after 11:10 AM. That means the administration server 20 stores the video data from 11:05 AM to 11:10 AM and the video data of the communication of between the user extensions 10 and the management devices 30 is generated after 11:10 AM. Thus, the video data is stored as backup for further investigations in case of the negligence and forgetting of the emergency due to panic.

In this preferred embodiment, the administration server 20 may generate an emergency report after the emergency. The administrator may edit the emergency report to record the process and result of handling the emergency. After the emergency report is generated, if a temporary storage instruction is received by the administration server 20, the administration server 20 will save the emergency report as not completely edited, and allows the emergency report to be further edited by the administrator when login information of the administrator is received. If the administration server 20 receives a storage instruction, it will save the emergency report as completely edited.

For instance, after the emergency, an emergency report may be generated by the administration server 20 for an administrator to edit. If the administrator needs to leave for taking a break or changing shift, the administrator may input a temporary storage instruction to hold the emergency report as not completely edited for further editing. When the administrator gets back to work and logs in, the administration server 20 will provide the emergency report for editing. After the report is done, the administrator may input the storage instruction to save the emergency report as completely edited.

Figure 6:
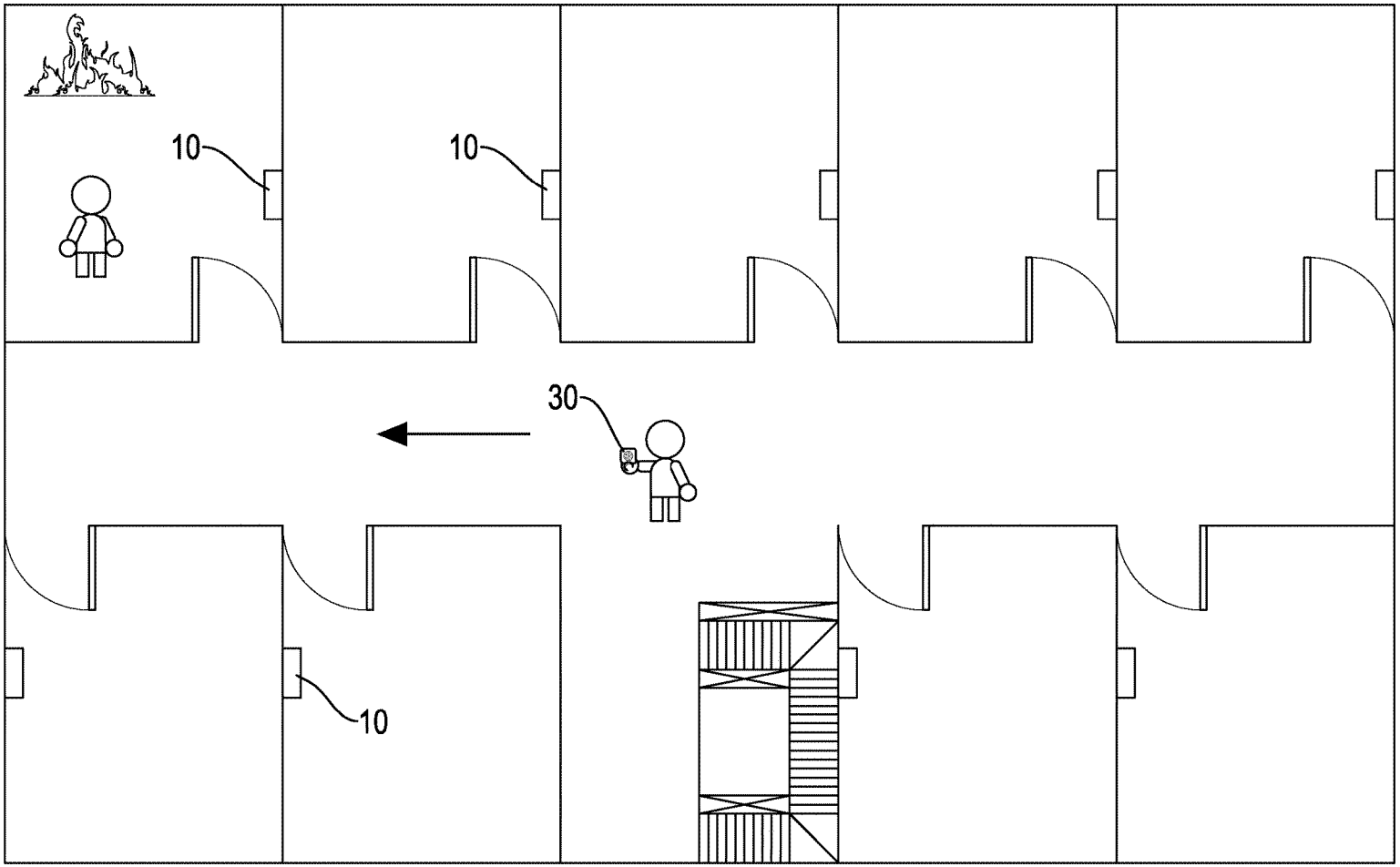
FIG. 6 is a plot plan used in the intercom system for emergency rescue in accordance with the present invention.
Figure 7:
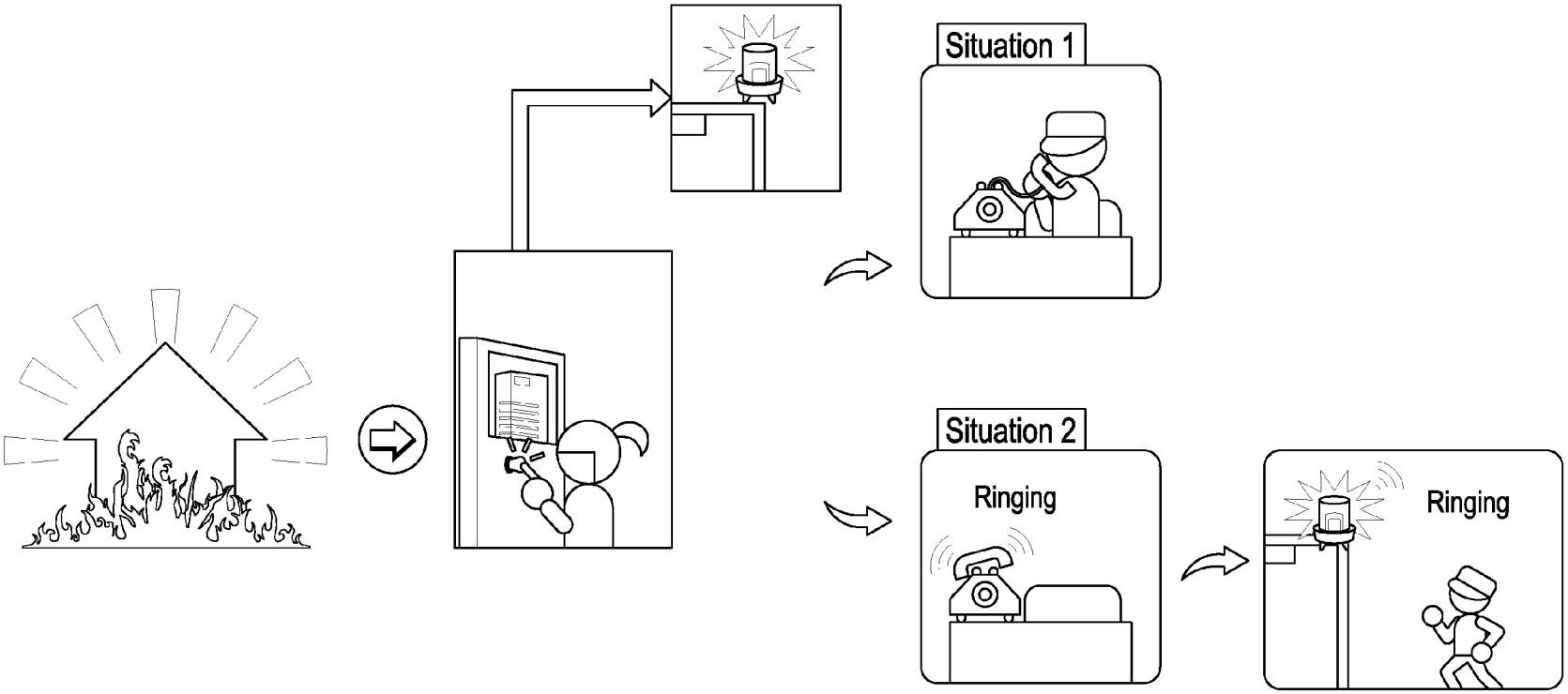
FIG. 7 to FIG. 10 show schematic views of operating a conventional emergency system.
Figure 8:
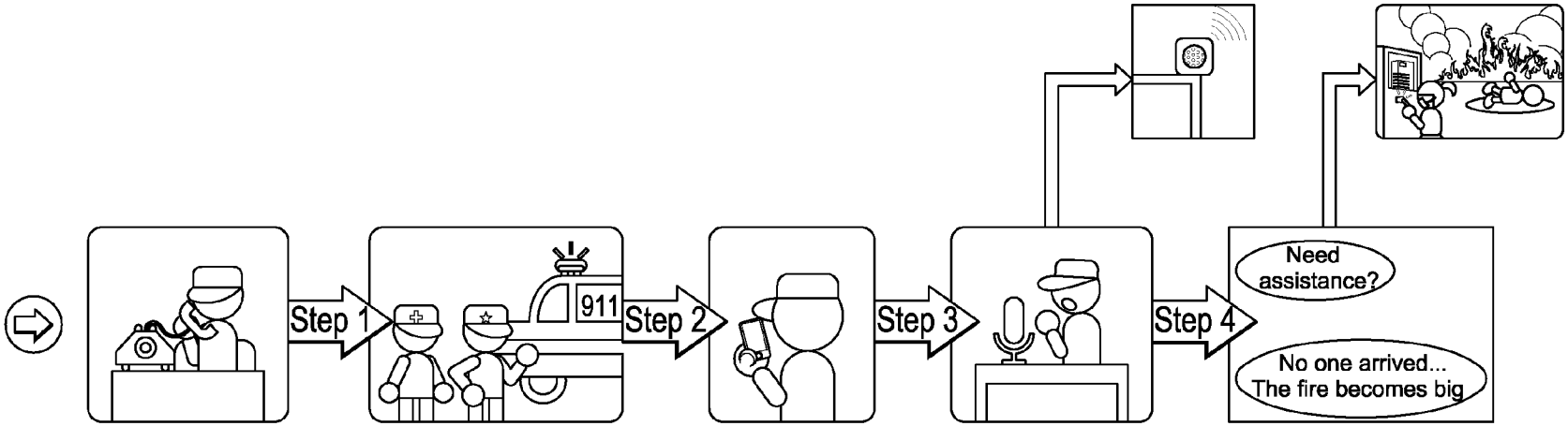
Figure 9:
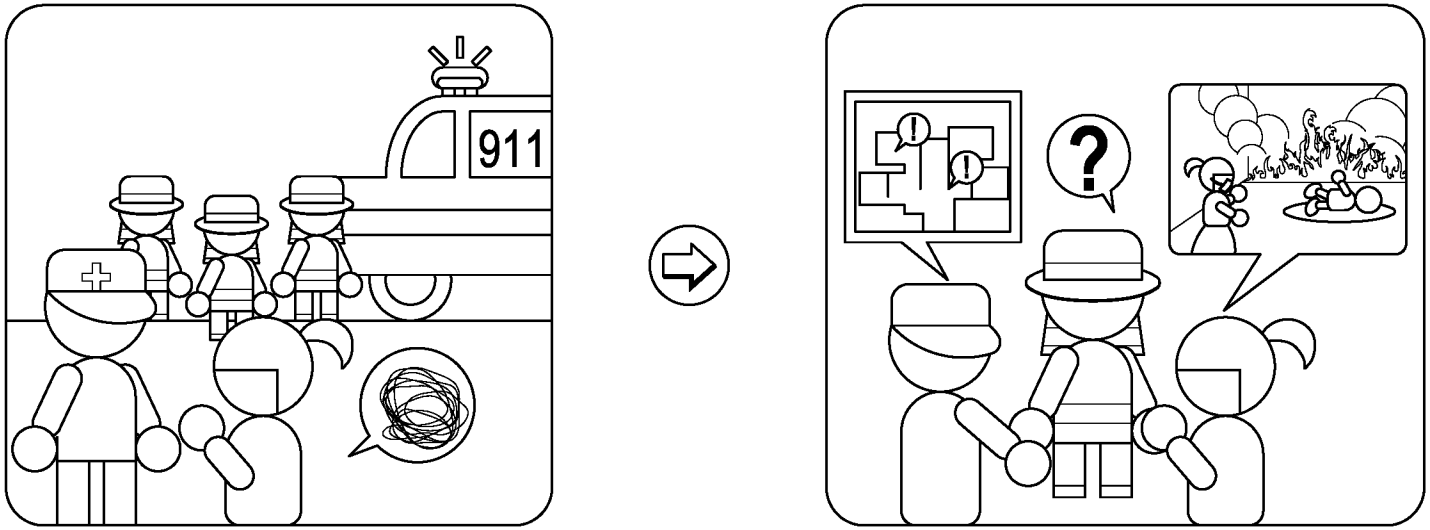
Figure 10:
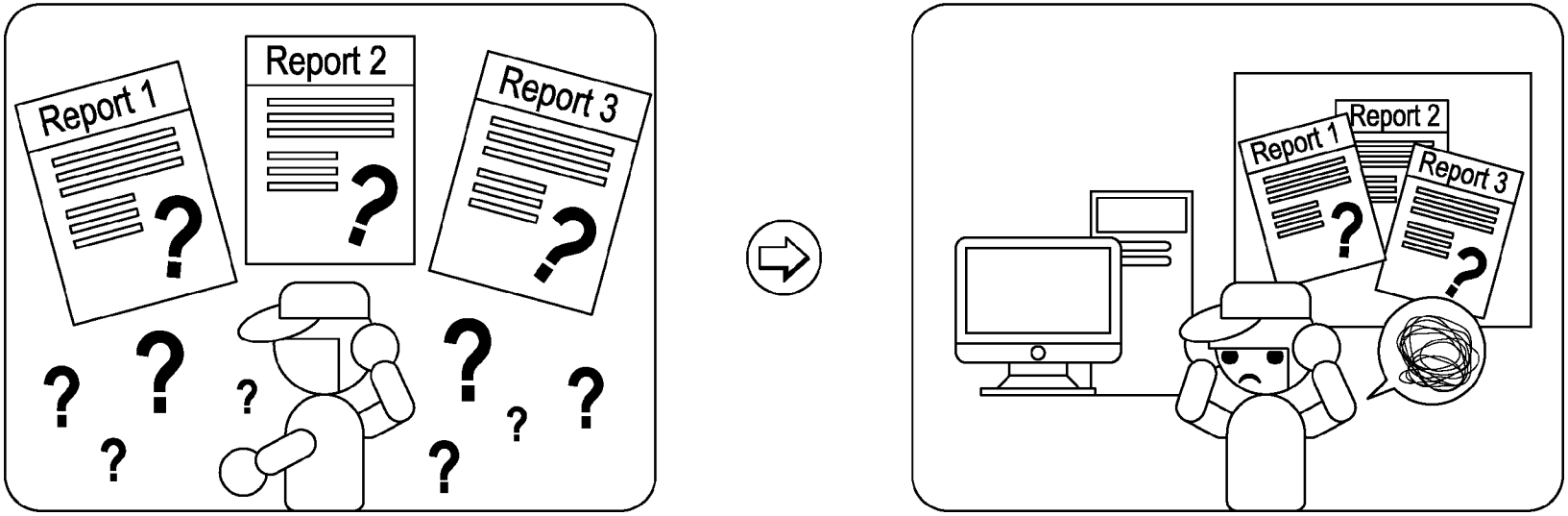

FIG. 6 is the schematic view of the usage of the present invention. When a room at the top left corner is on fire, a resident may directly operate the user extension 10 in the room to establish a connection with the administration server 20, and the administration server 20 establishes a video connection between the user extension 10 and the management device 30 equipped by the administrator. And the location of the user extension 10 is displayed in the plot plan on the management device 30 so that the administrator may rapidly find out the location of the fire in order to rescue and assist with fire fighting.

Furthermore, in this preferred embodiment, each of the user extensions 10 has a self-inspection function. The user extension 10 may inspect itself according to a schedule set by the administration server 20, and send an inspection result back to the administration server 20. If the inspection result reveals that there are function errors, the administration server 20 will send a reset instruction to the user extension 10 to reset the user extension 10. Otherwise, if the inspection result reveals that there are equipment failures, the administration server 20 will send a notification to the administrator via the management device 30 to notify the administrator for maintenance and repairing.

Moreover, the administration server 20 may establish video connection or an audio connection among the management device 30 with the multiple user extensions 10, thus the administrator may beam video or an audio broadcasting at the multiple user extensions 10 by the management device 30 via the administration server 20 to guide the residents to evacuate.

Furthermore, in this preferred embodiment, a resident may operate the user extension 10 to generate a first message, which can be an audio message or a video message, and then the user extension 10 sends the first message to the administration server 20 for storage, to another user extension 10 for storage, or further transmits the first message to the management device 30 for storage. Thus, when there is no emergency, the resident may operate the user extension 10 to generate the first message, and send the first message to the administration server 20 for storage or do further transmission of the first message to the management device 30 for storage. If the first message is stored in the administration server 20, the management device 30 will connect to the administration server 20 to acquire the first message. If the first message is already stored in the management device 30, the management 30 device will directly read it. The administrator may acquire what the resident aim to convey by reading the first message.

Comparably, the administrator may operate the management device 30 to generate a second message for a designated user extension. The second message can be an audio message or a video message. The second message is corresponding to the serial number of the designated user extension 10. The management device 30 sends the second message to the administration server 20 for storage or further transmits the message to the designated user extension 10 for storage. Thus, the administrator may designate one user extension 10 in advance to transmit the second message to the administration server 20 or further transmit the message to the designated user extension 10. The resident can obtain the second message through the designated user extension 10. If the second message is only stored in the administration server 20, the designated user extension 10 may connect to the administration server 20 to acquire the second message. If the second message has been transmitted to the designated user extension 10, the designated user extension 10 will directly read it.

Thus, preferred embodiments of the intercom system for emergency rescue have been disclosed. It should be apparent, however, to those skilled in the art that many more modifications besides those described are possible without departing from the invention concepts herein. The inventive subject matter, therefore, is not to be restricted in the spirit of the appended claims.

What is claimed is:

1. An intercom system for emergency rescue comprising:

at least one user extension each having a serial number and being capable of generating an alarm signal according to an operation;

an administration server connected to the at least one user extension either via a wired connection or a wireless connection in order to receive the alarm signal, wherein a plot plan is stored in the administration server and has a figure number corresponding to the serial number of the at least one user extension, and a location of the at least one user extension is shown on the plot plan, and a location of the at least one user extension is shown on the plot plan, the at least one user extension having a self-inspection function, the at least one extension inspects itself according to a schedule set by the administration server, and sends an inspection result back to the administration server;

wherein when the administration server receives the alarm signal outputted from the at least one user extension, the administration server affirms the serial number of the at least one user extension and recognizes the plot plan having the figure number corresponding to the serial number of the at least one user extension that outputs the alarm signal;

at least one management device connected to the administration server either via a wired connection or a wireless connection, when the administration server receives the alarm signal, the administration server establishes a video connection between the at least one management device and the at least one user extension and transmits the plot plan that has the figure number corresponding to the at least one user extension to the at least one management device, and responsive to the inspection result revealing that there are function errors occurring in the at least one user extension, the administration server sends a reset instruction to the at least one user extension to reset the at least one user extension.

2. The intercom system for emergency rescue as claimed in claim 1, wherein the at least one management device further stores reporting information corresponding to the serial number of the at least one user extension, and when the administration server receives the alarm signal generated by the at least one user extension, the administration server transmits the reporting information to the at least one management device.

3. The intercom system for emergency rescue as claimed in claim 2, wherein the reporting information comprises identity information, and when the administration server receives the alarm signal generated by the at least one user extension, the administration server sends an emergency alert according to the identity information to a receiving device.

4. The intercom system for emergency rescue as claimed in claim 1, wherein the administration server further generates an emergency report, and the administration server further determines that when a temporary storage instruction is received, the administration server saves the emergency report as not yet completely edited, and allows the emergency report to be edited by an administrator when login information of the administrator is received; and when a storage instruction is received, the administration server saves the emergency report as completely edited.

5. The intercom system for emergency rescue as claimed in claim 1, wherein the at least one management device is a personal computer, a mobile device or a wearable device.

6. The intercom system for emergency rescue as claimed in claim 1, wherein the at least one user extension establishes video connections to other user extensions via the administration server.

7. The intercom system for emergency rescue as claimed in claim 1, wherein video data transmitted via the video connection between the at least one user extension and the at least one management device is stored in the administration server.

8. The intercom system for emergency rescue as claimed in claim 7, wherein when the administration server receives the alarm signal, the administration server records a time that the alarm signal is received as a receiving time and stores the video data in a particular time period before the receiving time.

9. An intercom system for emergency rescue comprising:

at least one user extension each having a serial number and being capable of generating an alarm signal according to an operation;

an administration server connected to the at least one user extension either via a wired connection or a wireless connection in order to receive the alarm signal, wherein a plot plan is stored in the administration server and has a figure number corresponding to the serial number of the at least one user extension, and a location of the at least one user extension is shown on the plot plan, the at least one user extension having a self-inspection function, the at least one extension inspects itself according to a schedule set by the administration server, and sends an inspection result back to the administration server;

wherein when the administration server receives the alarm signal outputted from the at least one user extension, the administration server affirms the serial number of the at least one user extension and recognizes the plot plan having the figure number corresponding to the serial number of the at least one user extension that outputs the alarm signal;

at least one management device connected to the administration server either via a wired connection or a wireless connection, when the administration server receives the alarm signal, the administration server establishes a video connection between the at least one management device and the at least one user extension and transmits the plot plan that has the figure number corresponding to the at least one user extension to the at least one management device, and responsive to the inspection result revealing that there are equipment failures, the administration server sends a notification to the at least one management device.

10. The intercom system for emergency rescue as claimed in claim 1, wherein:

the at least one user extension is operated to generate a first message, and the at least one user extension sends the first message to the administration server for storage, to another user extension for storage, or further transmits the first message to the at least one management device for storage, wherein the first message is an audio message or a video message;

when the first message is only stored in the administration server, the at least one management device connects to the administration server to acquire the first message;

when the first message is stored in the at least one management device, the at least one management device directly reads the first message.

11. The intercom system for emergency rescue as claimed in claim 1, wherein:

the at least one management device is operated to generate a second message corresponding to the serial number of the at least one user extension, and the at least one management device sends the second message to the administration server for storage or further transmits the second message to the corresponding user extension for storage, wherein the second message is an audio message or a video message;

when the second message is only stored in the administration server, the at least one user extension connects to the administration server to acquire the second message;

when the second message is stored in the at least one user extension, the at least one user extension directly reads the second message.

12. The intercom system for emergency rescue as claimed in claim 1, wherein:

the at least one user extension is operated to generate a first message, and the at least one user extension sends the first message to the administration server for storage, to another user extension or further transmits the first message to the at least one management device for storage, wherein the first message is an audio message or a video message;

when the first message is only stored in the administration server, the at least one management device connects to the administration server to acquire the first message;

when the first message is stored in the at least one management device, the at least one management device directly reads the first message.

13. The intercom system for emergency rescue as claimed in claim 1, wherein:

the at least one management device is operated to generate a second message corresponding to the serial number of the at least one user extension, and the at least one management device sends the second message to the administration server for storage or further transmits the second message to the corresponding user extension for storage, wherein the second message is an audio message or a video message;

when the second message is only stored in the administration server, the at least one user extension connects to the administration server to acquire the second message;

when the second message is stored in the at least one user extension, the user extension directly reads the second message.

14. The intercom system for emergency rescue as claimed in claim 1, wherein a connection mode is in the form of a video connection or an audio connection established by the administration server and the connection mode is one of:

a connection between one of the at least one management device and one of the at least one user extension;

a connection between a plurality of the at least one management device and one of the at least one user extension;

a connection between one of the at least one management device and a plurality of the at least one user extension;

a connection between a plurality of the at least one management device and a plurality of the at least one user extension; and a connection between two user extensions;

whereby the administrator server beams a video broadcasting or an audio broadcasting to the user extensions to announce an evacuating guidance.

15. The intercom system for emergency rescue as claimed in claim 1, wherein a broadcasting in the form of a video connection or an audio connection is established by the administration server and the connection mode is one of:

a connection between one of the at least one management device and one of the at least one user extension;

a connection between a plurality of the at least one management device and one of the at least one user extension;

a connection between one of the at least one management device and a plurality of the at least one user extension;

a connection between a plurality of the at least one management device and a plurality of the at least one user extension; and a connection between two user extensions;

whereby the administrator server beams a video broadcasting or an audio broadcasting to the user extensions to announce an evacuating guidance.

16. The intercom system for emergency rescue as claimed in claim 14, wherein:

the at least one user extension is operated to generate a first message, and the at least one user extension sends the first message to the administration server for storage, to another user extension for storage or further transmits the first message to the management device for storage, wherein the first message is an audio message or a video message;

when the first message is only stored in the administration server, the at least one management device connects to the administration server to acquire the first message;

when the first message is stored in the at least one management device, the at least one management device directly reads the first message.

17. The intercom system for emergency rescue as claimed in claim 14, wherein:

the at least one management device is operated to generate a second message corresponding to the serial number of the at least one user extension, and the at least one management device sends the second message to the administration server for storage or further transmits the second message to the corresponding user extension for storage, wherein the second message is an audio message or a video message;

when the second message is stored in the administration server, the at least one user extension connects to the administration server to acquire the second message;

when the second message is stored in the at least one user extension, the at least one user extension directly reads the second message.

* * * * *